US006375515B1

(12) United States Patent
Higuchi

(10) Patent No.: US 6,375,515 B1
(45) Date of Patent: Apr. 23, 2002

(54) MODULAR JACK

(75) Inventor: Kunihiro Higuchi, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/774,565

(22) Filed: Feb. 1, 2001

(30) Foreign Application Priority Data

Feb. 2, 2000 (JP) ..... 2000-025462

(51) Int. Cl.[7] ..... H01R 24/00
(52) U.S. Cl. ..... 439/676; 439/607; 439/144
(58) Field of Search ..... 439/144, 676, 439/701, 607, 680

(56) References Cited

U.S. PATENT DOCUMENTS 4,423,288 A * 12/1983 Webb ..... 439/676
5,385,479 A * 1/1995 Okada ..... 439/144
5,395,268 A * 3/1995 Okada ..... 439/144
5,702,271 A * 12/1997 Steinman ..... 439/676
6,129,587 A * 10/2000 Huang ..... 439/607
6,220,900 B1 * 4/2001 Huang ..... 439/676

* cited by examiner

*Primary Examiner*—Tho D. Ta
*Assistant Examiner*—James R. Harvey
(74) *Attorney, Agent, or Firm*—Oblon, Spivak, McClelland, Maier & Neustadt, P.C.

(57) ABSTRACT

A resin casing of a two-piece structure includes a first resin casing having an engagement portion engaged with the engagement lever of a corresponding modular plug and a second resin casing for holding contact pins. A metal shell of a rectangular annular shape surrounds the peripheries of the resin casings and the metal shell is fixed to the resin casings. The metal shell defines the upper and lower surfaces of a concave portion into which the modular plug is inserted and from which the modular plug is removed.

21 Claims, 8 Drawing Sheets

MODULAR JACK

CROSS-REFERENCE TO RELATED APPLICATIONS

This application is related to and claims priority, under 35 U.S.C. § 119, from Japanese Patent Application No. 2000-025462, filed on Feb. 2, 2000, the entire contents of which are hereby incorporated by reference herein.

BACKGROUND OF THE INVENTION

1. Field of the Invention

The present invention relates to a modular jack which is mounted in a device such as a notebook personal computer etc. and in which a corresponding modular plug is fitted.

2. Discussion of Background

Usually, a notebook personal computer is provided with a modular jack for coupling a modular plug from a telephone line.

This modular jack is provided with a resin casing having an insertion concave portion into which the modular plug is inserted and from which the modular plug is removed.

In recent years, although it is desired to miniaturize and make thin the notebook personal computer, since the modular plug is uniquely determined in its configuration and size in accordance with the standard, the size of the insertion and removal concave portion of the modular jack can not be changed.

Thus, in the case of miniaturizing the modular jack, the resin casing is inevitably required to be thinned in its thickness. However, in this case, there arises a problem that the strength of the resin casing becomes insufficient.

SUMMARY OF THE INVENTION

Accordingly, the invention has been made in view of the aforesaid problem of the conventional technique and an object of the invention is to provide a modular jack which is small in size and thin in thickness and has sufficient strength.

In order to attain the aforesaid object, a modular jack according to the invention is characterized by including a jack body for opening an insertion concave portion in a forward direction in which a modular plug having a plug body and an engagement lever of a cantilever fashion is inserted and from which the modular plug is removed, wherein the jack body includes a resin casing having a first side wall with an engagement portion and a second side wall for holding a contact pin, and a metal shell which covers a part of external surface of the resin casing and is fixed to the resin casing, and wherein the insertion concave portion is defined by a part of the metal shell in correspondence to upper and lower surfaces of the plug body.

According to the invention, for example, most of the upper and lower walls of the resin casing of the modular jack is eliminated and the upper and lower surfaces of the insertion concave portion are defined by the metal shell; therefore, the height of the modular jack can be lowered to the limit value. Further, since the resin casing is reinforced by the metal shell, the modular jack can ensure high strength despite that it is small in size and thin in thickness.

Preferably, the metal shell is arranged in a rectangular annular shape so as to surround periphery of the resin casing. In this case, since the metal casing surrounds the periphery of the resin casing to reinforce the resin casing, higher strength can be ensured.

Further preferably, the resin casing is arranged in a two-piece structure having a first resin casing with the first side wall and a second resin casing with the second side wall. According to this configuration, in the case of defining the upper and lower surfaces of the insertion concave portion by the metal shell, when the resin casing is arranged in a two-piece structure separated in the left and right portions, the thickness of the resin casing can be reduced remarkably, which contributes to the miniaturization and thinning of the modular jack to a large extent.

In addition, a rear surface of the jack body preferably includes an opening portion which introduces a base end portion of the engagement lever in a state where the modular plug is disposed at a deepest pushed position.

According to the modular plug as a standardized goods, the base end portion of the engagement lever is disposed at the most protruded position on the insertion side of the modular plug. In contrast, according to the invention thus configured, the base end portion of the engagement lever disposed at the deepest pushed position is introduced to the opening portion so that the base end portion and the rear surface of the jack body can be almost aligned on the same plane, whereby the depth of the jack body can be minimized as small as possible. According to this feature, the modular jack also can be miniaturized.

BRIEF DESCRIPTION OF THE DRAWINGS

FIG. 2 (*b*) is a right side view of the modular jack.

DETAILED DESCRIPTION OF THE PREFERRED EMBODIMENTS

The preferred embodiments of the invention will be explained with reference to the accompanying drawings.

Figure 1:
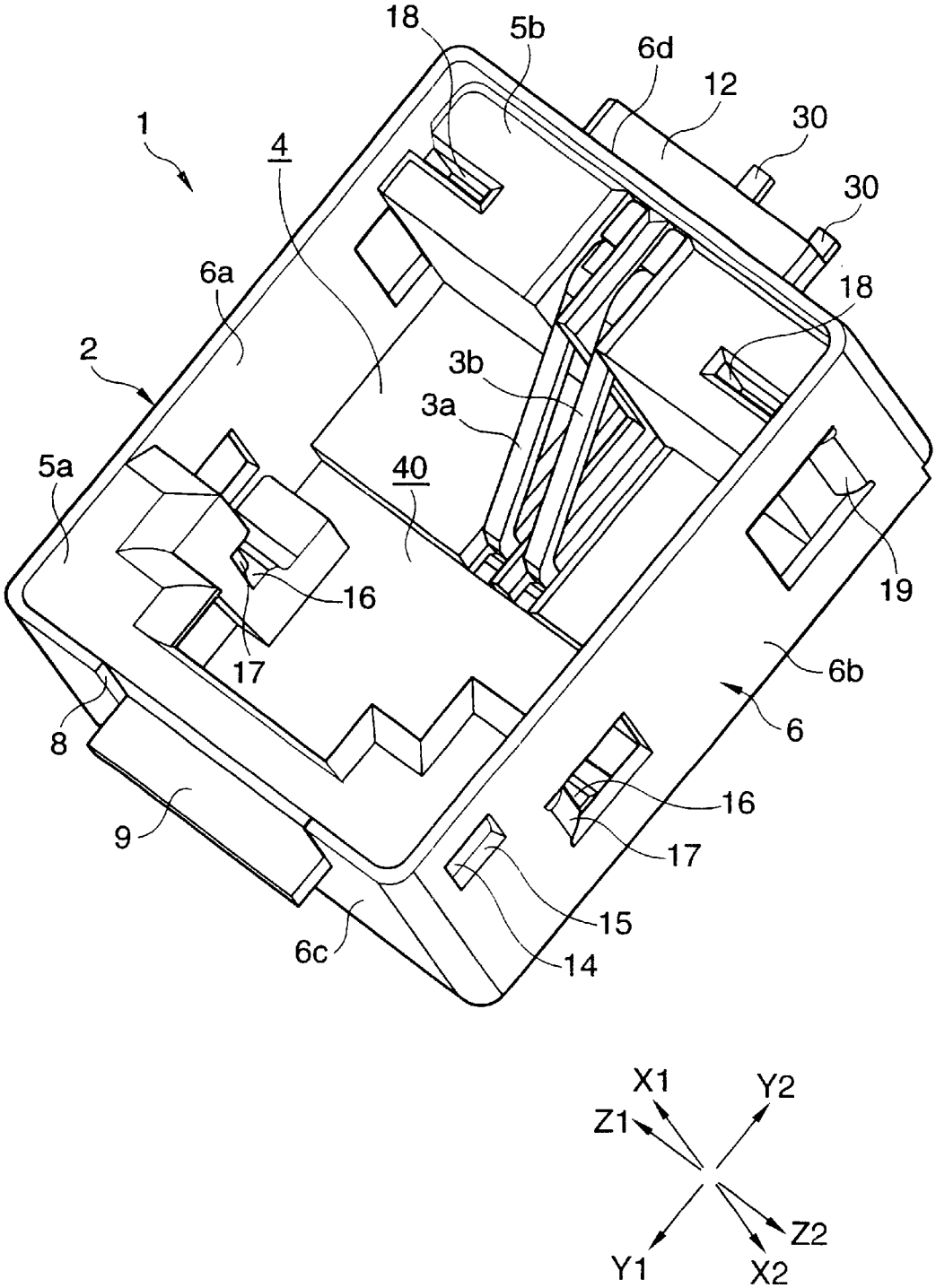
FIG. 1 is a perspective view of a modular jack according to an embodiment of the invention.
Figure 5:
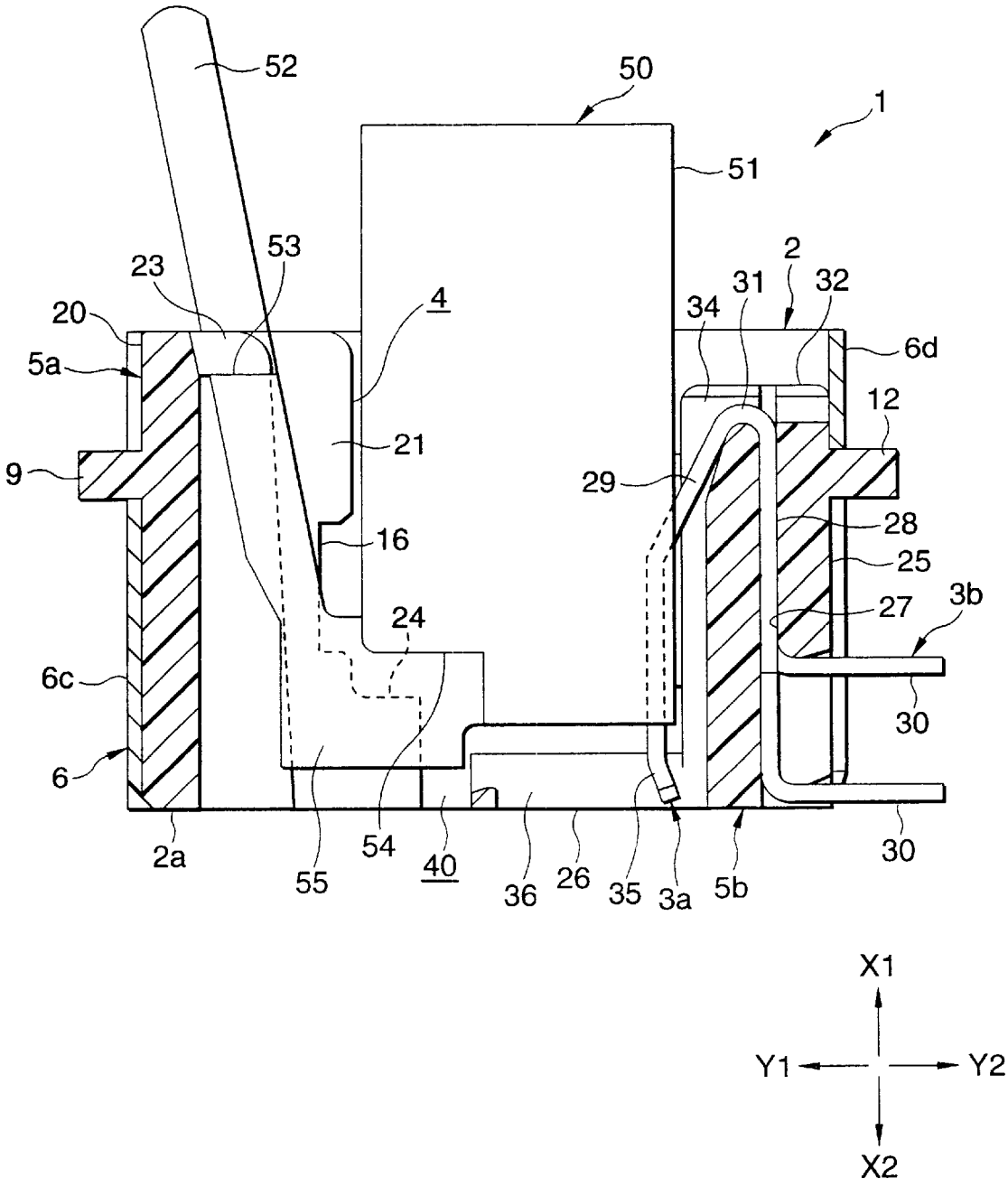
FIG. 5 is a sectional view of the modular jack in a state where the modular jack is coupled, wherein the hatching representing sectional portion is omitted as to the contact pins.

FIG. 1 is a schematic perspective view of a modular jack (transverse type modular) according to an embodiment of the invention. The modular jack is used for coupling a modular plug 50 as a standardized goods as shown in FIG. 5. The modular plug 50 includes a plug body 51 for holding a plurality of contact pins (not shown) and an engagement lever 52 which can be elastically deformed and supported in a cantilever manner at its base end portion 55 by the plug body 51. The engagement lever 52 has a pair of engagement step portions 53 (only one of the pair is shown in the figure).

Referring to FIG. 1, the modular jack (transverse type modular) 1 includes a jack body 2 and two-pole contact pins 3*a*, 3*b* each having a lead portion 30. The jack body 2 is provided with an insertion and removal concave portion 4 which is opened in the front direction. The modular plug 50 is coupled to the insertion and removal concave portion 4 so as to be freely inserted therein and removed therefrom to thereby electrically and mechanically couple them. In FIG. 1, X1 and X2 represent the front and rear directions of the casing 2, Y1 and Y2 represent the left and right directions of the casing 2, and Z1 and Z2 represent the upper and lower directions of the casing 2, respectively. These signs represent the same directions in the following figures.

The jack body 2 is configured by first and second resin casings 5*a*, 5*b* arranged in a two-piece structure and a metal shell 6 integrally forming a casing in combination with the resin casings 5*a*, 5*b*. The metal shell 6 is configured by a belt-shaped plate of a rectangular annular shape having an upper surface portion 6*a*, a lower surface portion 6*b*, a left side surface portion 6*c* and a right side surface portion 6*d*. The jack body 2 is provided at its rear surface with an opening portion 40 of an almost rectangular shape for opening the insertion concave portion 4 in the rear direction.

Figure 2A:
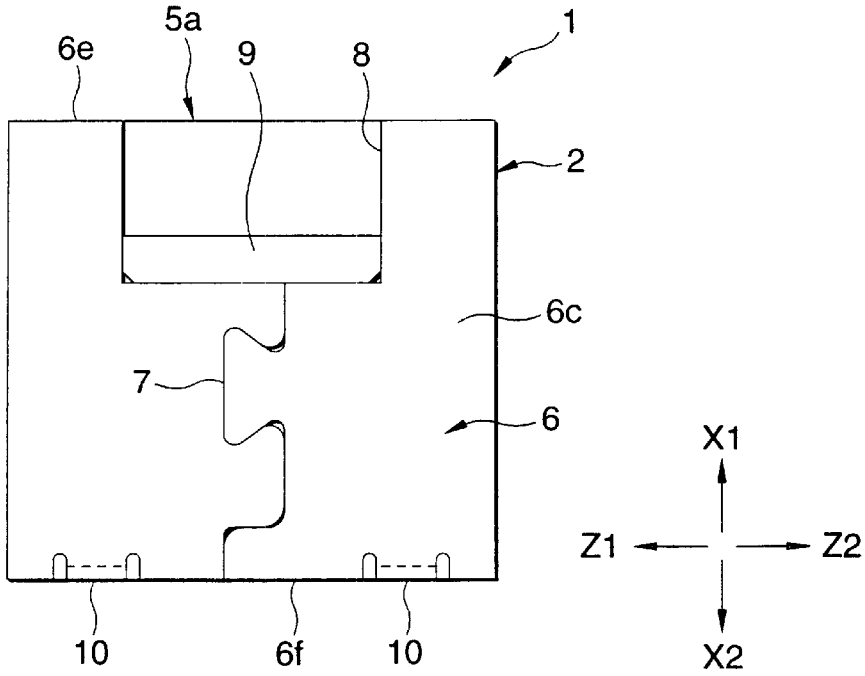
FIG. 2(*a*) is a left side view of the modular jack.
Figure 2B:
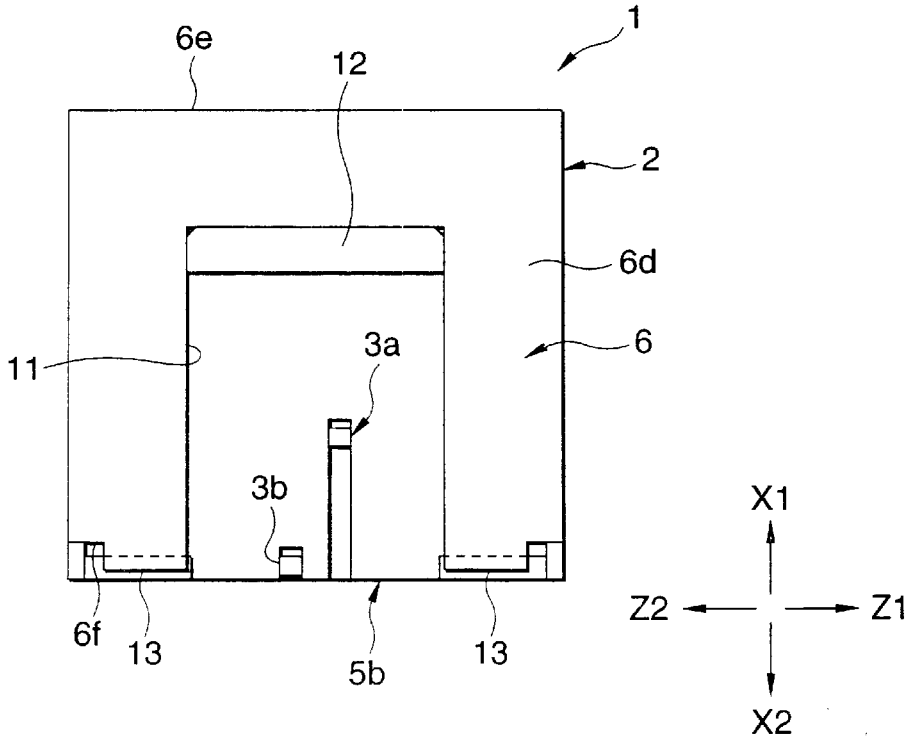

Referring to FIG. 2(*a*) showing the left side view of the modular jack 1, the metal shell 6 is provided at its left side surface portion 6*c* with a caulked coupling portion 7 which is fitted and caulked in a shiplap manner. Further, an engagement groove 8 is formed so as to have a predetermined depth from the front edge 6*e* of the left side surface portion 6*c*. The engagement projection 9 (also refer to FIG. 1) of the first resin casing 5*a* engages with the groove bottom of the engagement groove 8. Referring to FIG. 2(*a*), a pair of engagement pieces 10, 10 bent in a rectangular shape are provided so as to extend from the rear edge 6*f* of the left side surface portion 6*c*. These pair of engagement pieces 10, 10 engage with a pair of engagement concave portions (not shown) on the rear surface of the first resin casing 5*a*, respectively. Each of the engagement pieces 9 is provided at its both sides with cut grooves, respectively.

Referring to FIG. 2 (*b*) showing the right side view of the modular jack 1, the metal shell 6 is provided at its right side surface portion 6*d* with an engagement groove 11 which is formed so as to have a predetermined depth from the rear edge 6*f*. The engagement projection 12 (also refer to FIG. 1) of the second resin casing 5*b* engages with the groove bottom of the engagement groove 11. Referring to FIG. 2(*b*), a pair of engagement pieces 13 bent in a rectangular shape are provided so as to extend from the rear edge 6*f* of the both sides sandwiching the engagement groove 11. These pair of engagement pieces 13, 13 engage with a pair of engagement concave portions (not shown) on the rear surface of the second resin casing 5*b*, respectively.

Referring to FIG. 1 again, the metal shell 6 is provided at its lower surface portion 6*b* with a fitting hole 15 of an almost rectangular shape for fitting the fitting projection 14 of the first resin casing 5*a* therein. The metal shell is also provided at its lower surface portion 6*b* with an engagement piece 17, engaging with the engagement concave portion 16 of the first resin casing 5*a*, which is formed by cutting and raising apart of the lower surface portion so as to form a window portion and by bending the raised portion inward. Further, the metal shell is provided at its lower surface portion with a fitting piece 19, fitted into the fitting groove 18 of the second resin casing 5*b*, which is also formed by cutting and raising a part of the lower surface portion so as to form a window portion and by bending the raised portion inward. The metal shell 6 is also provided at its upper surface portion 6*a* with a fitting hole 15 (not shown), an engagement piece 17 and a fitting piece 19 (not shown).

Figure 3:
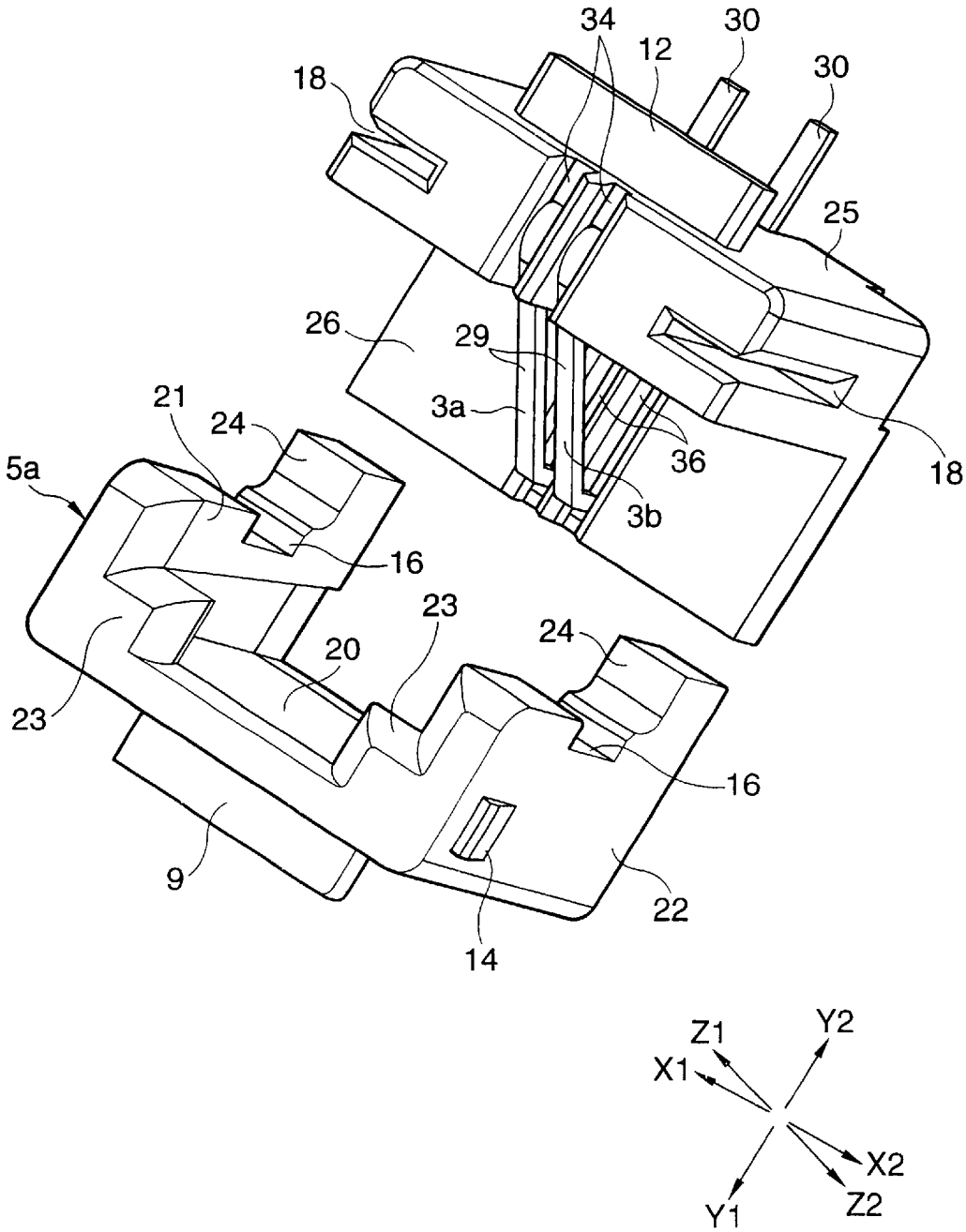
FIG. 3 is an exploded perspective view of the resin casing.

Then, referring to FIG. 3 showing an exploded perspective view of the resin casing, the first resin casing 5*a* includes a left wall 20, an upper wall 21 and a lower wall 22 serving as a first side wall. The aforesaid engagement projection 9 is formed on the external surface of the left wall 20 so as to protrude in the left direction. The aforesaid fitting projections 14 are formed on the external surfaces of the upper wall 21 and the lower wall 22 (only the fitting projection 14 of the lower wall 22 is shown in FIG. 3).

A pair of engagement portions 23 are protrusively formed at the corner portion of the front edge portion of the left wall 20 and the upper wall 21 and at the corner portion of the front edge portion of the left wall 20 and the lower wall 22, respectively. Each of the engagement portions 23 engages with the corresponding engagement step portion 53 of the engagement lever 52 of the modular plug 50 as shown in FIG. 5. In this state, the modular plug 50 is prevented from being removed from the insertion concave portion 4 of the modular plug 50, and the coupling state between the contact pins 3*a*, 3*b* and the contact pins of the corresponding modular plug 50 can be maintained.

The aforesaid engagement concave portions 16 are formed at the center portions along the longitudinal direction of the upper wall 21 and the lower wall 22, respectively. A positioning portion 24 protruding to the second resin casing 5*b* side is formed at the rear end of each of the upper wall 21 and the lower wall 22. These positioning portions 24 abut against the step portion 54 of the insertion side end surface of the plug body 51 which is inserted into the insertion concave portion 4, whereby the positioning portions serve as positioning stoppers for restricting the deepest pushed position of the modular plug 50.

The second resin casing 5*b* includes a right wall 25 and a rear wall 26. The aforesaid engagement projection 12 is formed on the right wall 25 so as to protrude in the right direction. The aforesaid fitting grooves 18 are formed on the upper surface and the lower surface of the right wall 25, respectively. The rear wall 26 holds the aforesaid contact pins 3*a*, 3*b*.

Figure 4:
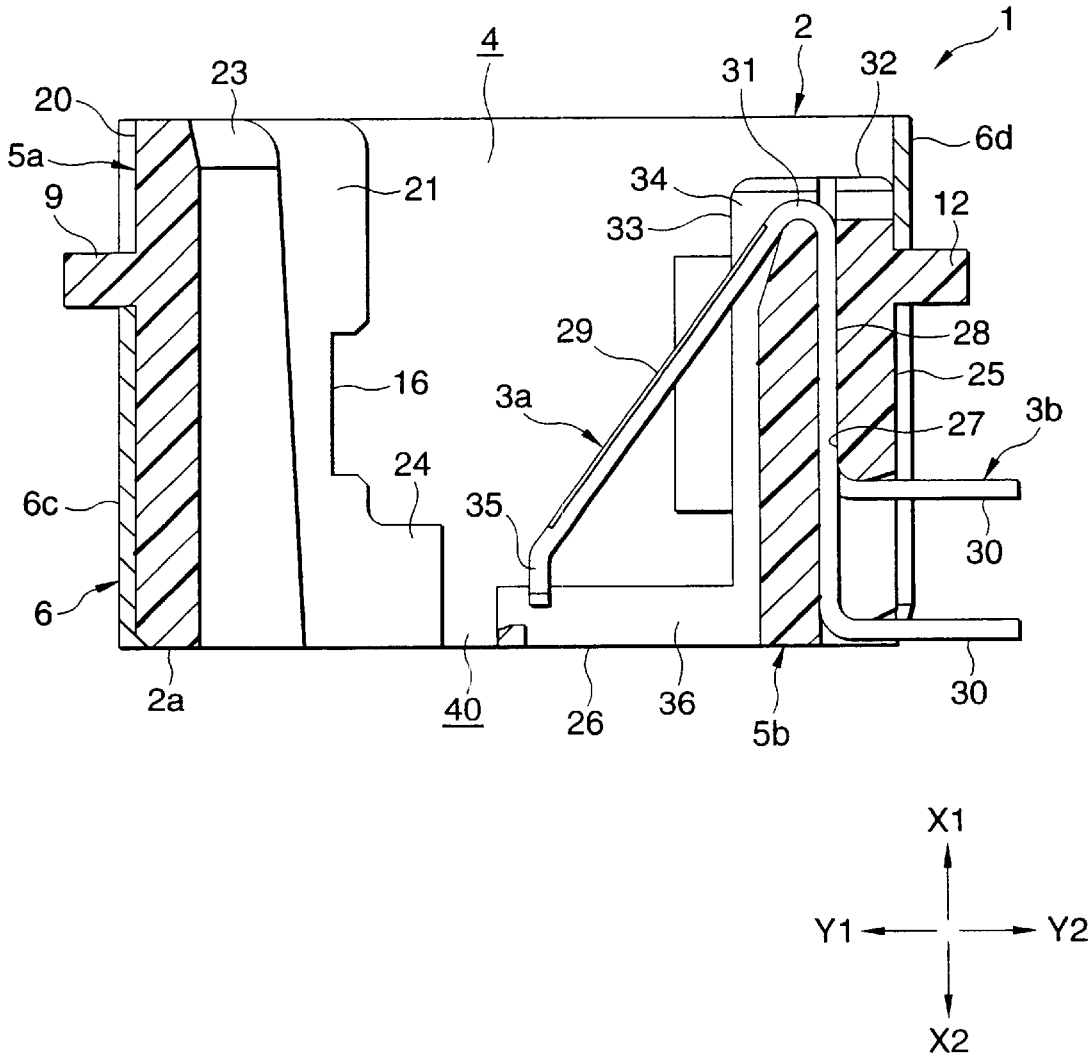
FIG. 4 is a sectional view of the modular jack, wherein the hatching representing sectional portion is omitted as to the contact pins.

To be more concrete, as shown in FIG. 4, the contact pin 3*a* includes: a fixing portion 28 which is inserted and fixed to a fixing hole 27 which passes through the right wall 13 along the longitudinal direction of the resin casing 5*b;* an elastic contact portion 29 of a cantilever fashion which is bent with an acute angle from the front end of the fixing portion 28 and extends in a slanted manner toward the rear wall 26; and a lead portion 30 which is bent with an almost right angle from the rear end of the fixing portion 28 and protrudes outward of the right wall 25. The contact pin 3*b* has almost the same configuration as the contact pin 3*a* but differs from the contact pin 3*a* in a point that the length of the fixing portion 28 is set to be slightly shorter than that of the contact pin 3*a*. According to such a configuration, the lead portions 30 of the contact pins 3*a*, 3*b* are shifted in their positions in the front and rear direction to each other.

Referring to FIGS. 3 and 4, the base end portion 31 of the elastic contact portion 29 is guided by a guide groove 34 which is provided over the front end surface 32 and the inner surface 33 of the right wall 25. A bend portion 35 is provided at the tip end of the elastic contact portion 29. The bend portion 35 is guided by a guide groove 36 which is provided in the rear wall 26 so as to continue to the guide groove 34 and extended in the transverse direction so that the bend portion can slide in the transverse direction (left and right direction).

According to the embodiment, most of the upper and lower walls of the resin casings 5*a*, 5*b* of the modular jack 1 is eliminated and the upper and lower surfaces of the insertion concave portion 4 are defined by the metal shell 6; therefore, the height of the modular jack 1 can be lowered to the limit value. Further, since the metal shell 6 which is thin in thickness but has sufficient strength is employed in combination with the resin casings 5*a*, 5*b*, the modular jack can ensure high strength despite that it is small in size and thin in thickness.

In particular, since the metal shell 6 is configured in the rectangular annular shape so as to surround the peripheries of the resin casings 5*a*, 5*b* to thereby reinforce the casings, the higher strength can be ensured.

Further, the metal shell 6 is employed and the resin casings 5*a*, 5*b* are configured as the two-piece structure separated in the right and left portions, so that the thickness of the resin casings can be reduced to a large extent. Such a fact largely contributes to the miniaturization and thinning of the modular jack.

Figure 6:
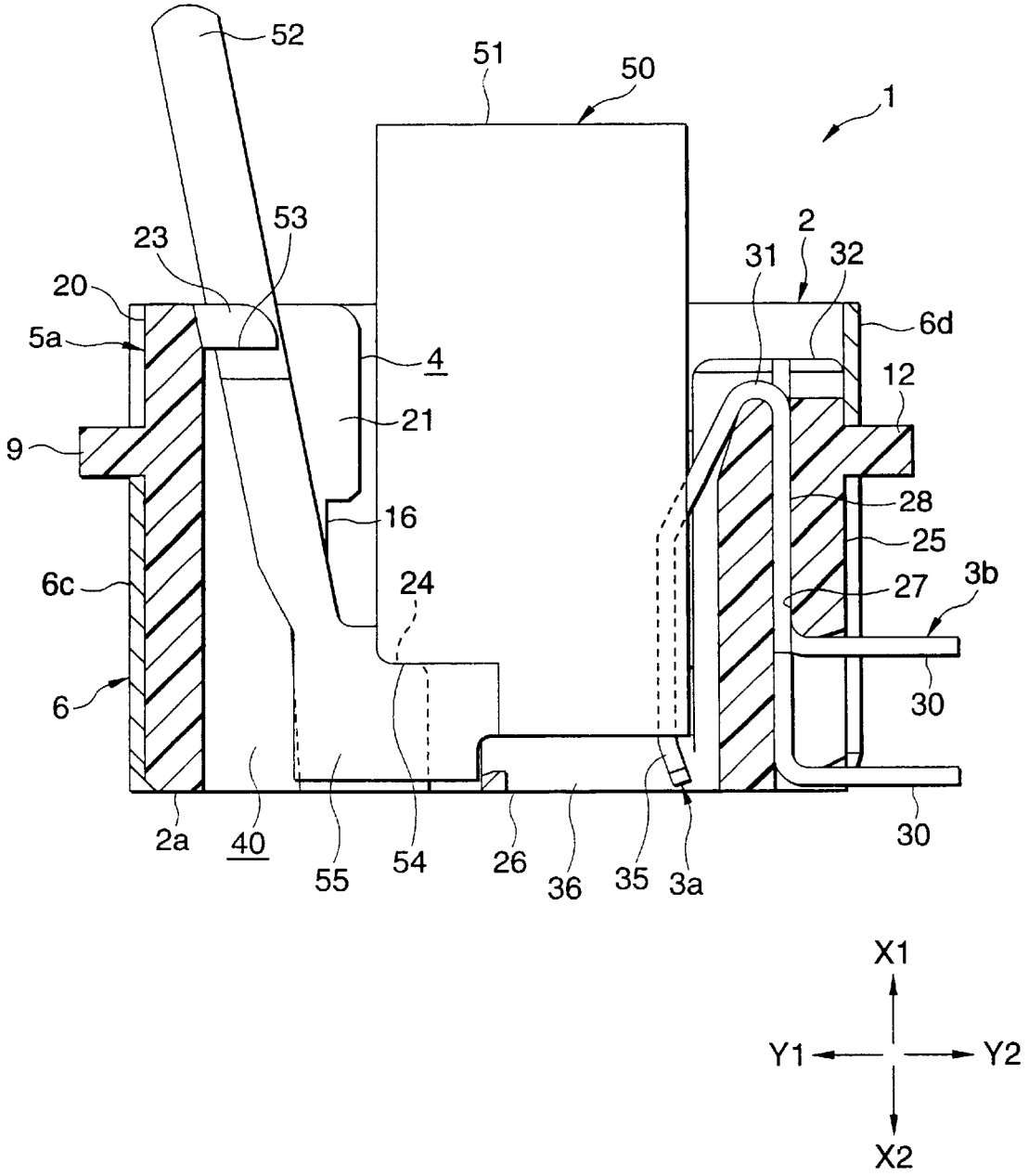
FIG. 6 is a sectional view of the modular jack in a state where the modular jack reaches the deepest pushed position, wherein the hatching representing sectional portion is omitted as to the contact pins.

Furthermore, according to the modular plug 50 as a standardized goods, the base end portion 55 of the engagement lever 52 is disposed at the most protruded position on the insertion side of the modular plug 50. In contrast, according to the embodiment, as shown in FIG. 6, the base end portion 55 of the engagement lever 52 disposed at the deepest pushed position is introduced to the opening portion 40 so that the base end portion 55 and the rear surface 2*a* of the jack body 2 can be almost aligned on the same plane, whereby the depth of the jack body 2 can be minimized as small as possible. According to this feature, the modular jack also can be miniaturized. Incidentally, when the modular plug 50 is disposed at the deepest pushed position shown in FIG. 6, the step portion 54 of the insertion side end surface of the plug body 51 abuts against the positioning portion 24 of the first resin casing 5*a* and the remaining portion of the insertion side end surface of the plug body 51 abuts against the rear wall 26 of the second resin casing 5*b*.

Figure 7:
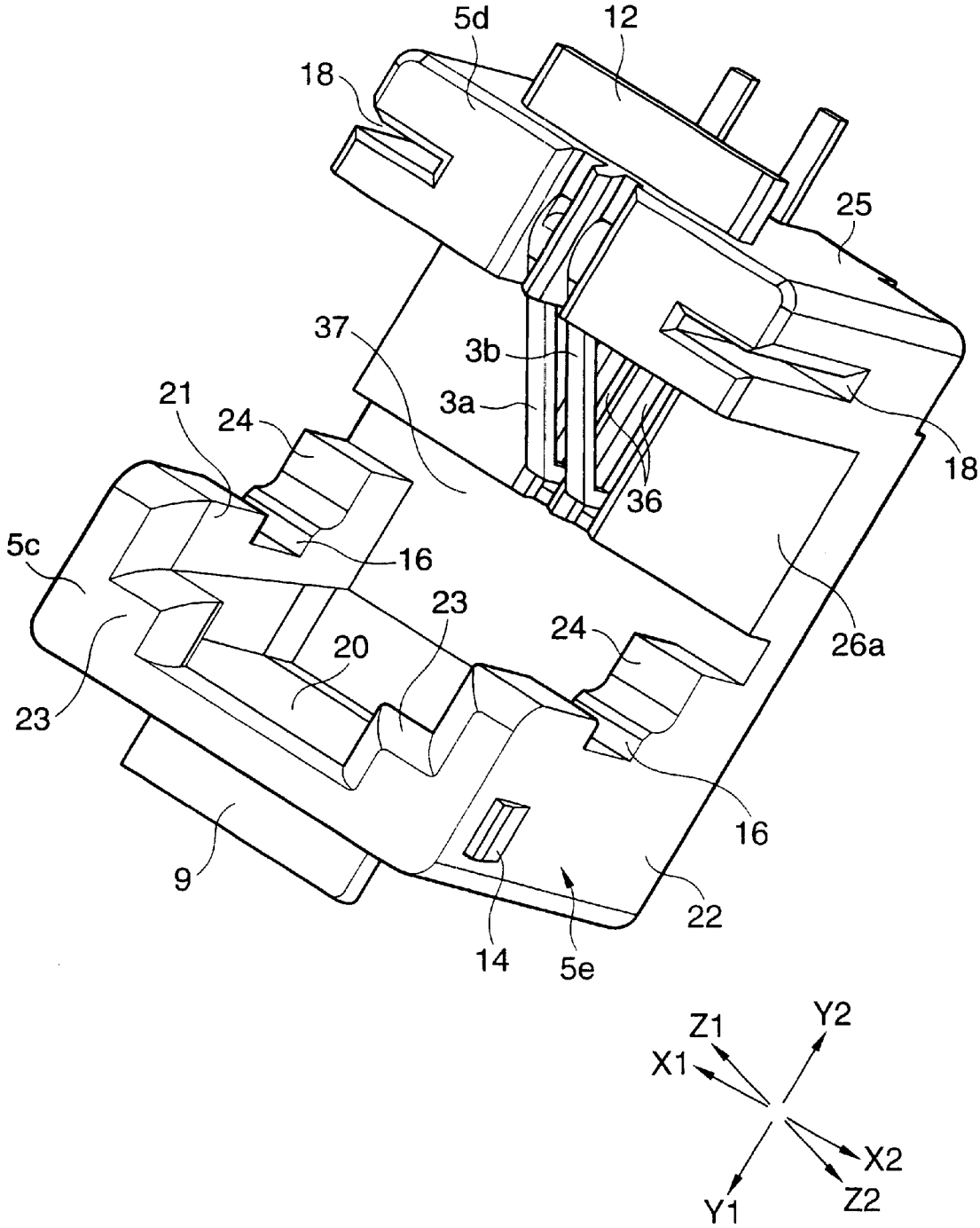
FIG. 7 is a perspective view of the resin casing of a modular jack according to another embodiment of the invention.
Figure 8:
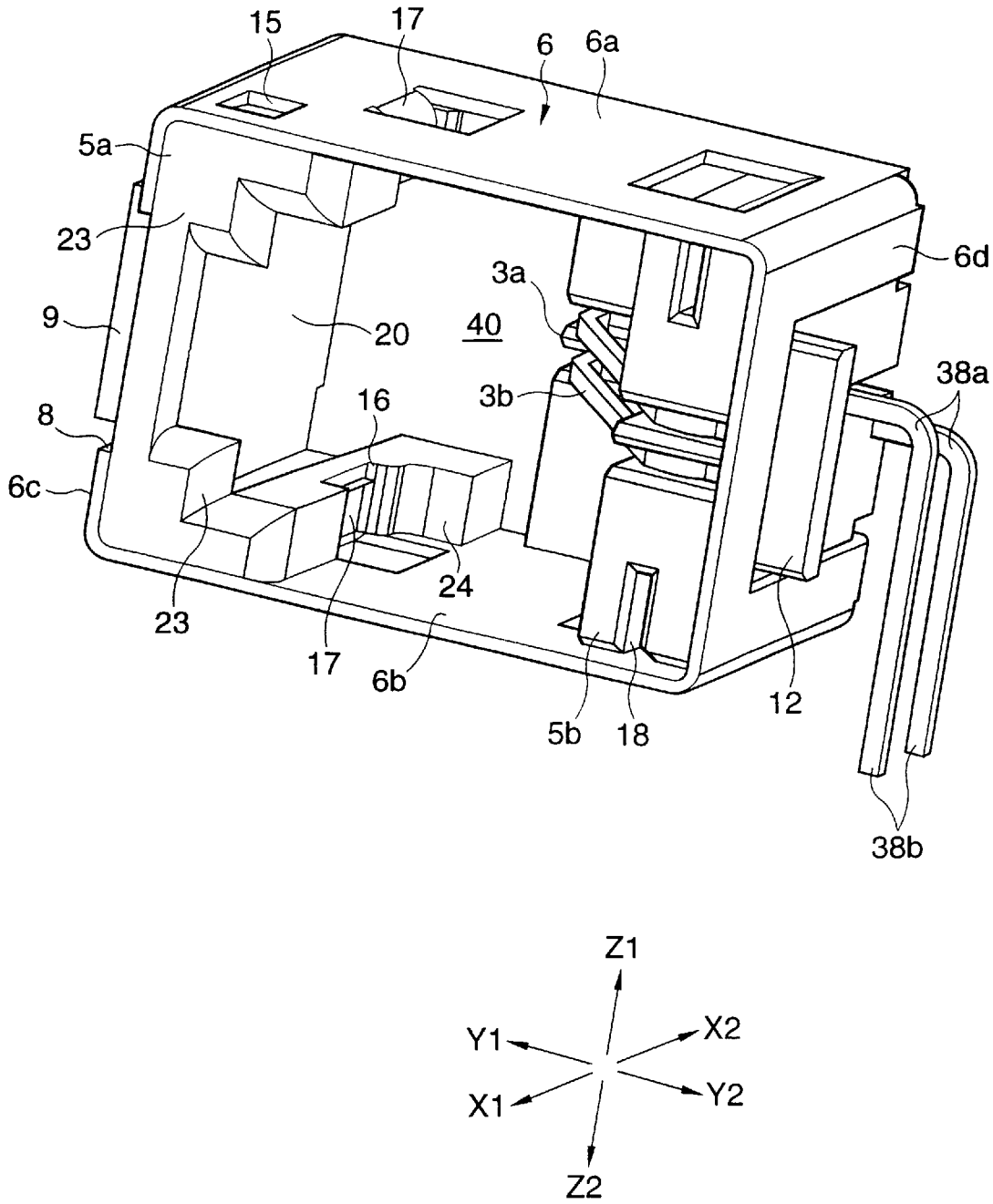
FIG. 8 is a perspective view of a modular jack according to still another embodiment of the invention.

FIG. 7 is a perspective view of the resin casing according to another embodiment of the invention. This embodiment differs from the embodiment of FIG. 3 in a point that, although the embodiment of FIG. 1 is provided with the pair of resin casings 5*a*, 5*b* and the opening portion 40, this embodiment eliminates the opening portion but is provided with an integrated resin casing 5*e* having a first portion 5*c* and a second portion 5*d* which are coupled through a rear wall 37, as shown in FIG. 7. 26*a* depicts a portion corresponding to the rear wall 26 of the embodiment shown in FIG. 1 and this portion is contained in the rear wall 37 in this embodiment. Since other portions of this embodiment are same as those of the embodiment shown in FIG. 1, portions identical to those of FIG. 1 are referred to by the common symbols, with explanation thereof being omitted FIG. 8 is a perspective view of the modular jack according to still another embodiment of the invention. Referring to FIG. 8, this embodiment differs from the embodiment of FIG. 1 in a point that, although in the embodiment of FIG. 1 the respective lead portions 30 extend straightly in the right direction Y2, in this embodiment, the lead portion 38 of each of the contact pins 3*a*, 3*b* is configured in an almost L-shape to have a portion 38*a* extending in the right direction Y1 and a portion 38*b* which is bent with a right angle from the tip end of the portion 38*a* and extends in the lower direction Z2. The tip ends of the both contact pins 3*a*, 3*b* may be or may not be shifted in opposite directions (right and left directions Y1 and Y2) along the transverse direction to each other. Since other configuration of this embodiment is same as that of the embodiment shown in FIG. 4, portions identical to those of FIG. 4 are referred to by the common symbols, with explanation thereof being omitted.

According to the modular jack according to this embodiment, the L-shaped lead portion facilitates installation of the modular jack in a limited space, for example, in a miniaturized notebook personal computer.

The invention is not limited to the aforesaid respective embodiments, and the invention may be modified in a manner, for example, that the contact pins 3*a*, 3*b* are replaced by three pairs, that is, six pins or four pairs, that is, eight pins. The invention can be modified in various manner without departing from the scope of the invention.

What is claimed is:

1. A modular jack having a jack body with an insertion concave portion through a front thereof, said insertion concave portion adaptable to receive a modular plug, the modular plug having a plug body and an engagement lever supported on the plug body in a cantilever fashion such that when the engagement lever of the modular plug is in a depressed state, the plug body of the modular plug is insertable into and removable from said jack body, said modular jack comprising:

a resin casing forming a two-piece structure, a first piece of said two-piece structure of said resin casing having a first side wall and an engagement portion, and a second piece of said two-piece structure of said resin casing having a second side wall for holding at least one contact pin therein; and a metal shell which covers a part of an external surface of said resin casing and is fixed to said resin casing, said insertion concave portion being defined by a part of said metal shell which correspond to upper and lower surfaces of the plug body, and said first and second pieces of said resin casing being housed within said metal shell so that said first piece of said resin casing is arranged beside said second piece of said resin casing so as not to touch said second piece of said resin casing.

2. The modular jack according to claim 1, wherein said metal shell has an approximately rectangular shape in cross-section so as to surround an outer periphery of said resin casing.

3. The modular jack according to claim 1, wherein a rear surface of said jack body includes an opening portion which is adapatable to being adjacent to a base end portion of the engagement lever of the modular plug when the modular plug is disposed within said jack body at a deepest pushed position of the modular plug.

4. The modular jack according to claim 1, wherein said at least one contact pin is two contact pins, each of said two contact pins having a linear lead portion extending outwardly from a right side surface portion of said metal shell.

5. The modular jack according to claim 1, wherein:

said first piece of said two-piece structure of said resin casing is fixed to said metal shell via first and second engagement pieces in said metal shell which mate with first and second engagement concave portions in said first piece of said two-piece structure of said resin casing; and said second piece of said two-piece structure of said resin casing is fixed to said metal shell via first and second fitting pieces in said metal shell which mate with first and second fitting grooves in said second piece of said two-piece structure of said resin casing.

6. The modular jack according to claim 1, wherein said engagement portion of said first piece of said two-piece structure of said resin casing extends into said insertion concave portion from said first side wall of said first piece of said two-piece structure of said resin casing so as to engage a engagement step portion of the engagement lever of the modular plug when the modular plug is disposed in a deepest pushed position within said jack body.

7. The modular jack according to claim 1, wherein said resin casing has engagement projections extending outwardly from said first and second side walls of said resin casing past said metal shell.

8. A modular jack for accommodating a modular plug, the modular plug including a plug body and an engagement lever, said modular jack comprising:

a resin casing being a one-piece integral structure having a first resin casing portion which includes a first side wall having an engagement portion adaptable to engage the engagement lever of the modular plug, and a second resin casing portion including a second side wall for holding at least one contact pin; and a metal shell covering a part of an external surface of said resin casing and fixed to said resin casing, an insertion concave portion being defined in a jack body of said modular jack by said resin casing and said metal shell such that when the modular plug is inserted into said insertion concave portion, lower portions of first and second side walls of the plug body of the modular plug face at least parts of inner surfaces of upper and lower surface portions of said metal shell with no resin material of said resin casing being therebetween.

9. The modular jack according to claim 8, wherein said metal shell has an approximately rectangular shape in cross-section so as to surround an outer periphery of said resin casing.

10. The modular jack according to claim 8, wherein an opening portion is defined by said resin casing and said metal shell, and said opening portion is located adjacent to a base end portion of the engagement lever of the modular plug when said insertion concave portion of said jack body houses the modular plug at a deepest pushed position of the modular plug.

11. The modular jack according to claim 8, wherein said at least one contact pin is first and second contact pins, and each of said first and second contact pins are connected to an L-shaped lead portion, said L-shaped lead portion extending outwardly from a right side surface portion of said metal shell.

12. The modular jack according to claim 8, wherein:

said first resin casing portion is fixed to said metal shell via first and second engagement pieces in said metal shell which mate with first and second engagement concave portions in said first resin casing portion; and said second resin casing portion is fixed to said metal shell via first and second fitting pieces in said metal shell which mate with first and second fitting grooves in said second resin casing portion.

13. The modular jack according to claim 8, wherein said engagement portion of said first piece of said two-piece structure of said resin casing extends into said insertion concave portion from said first side wall of said first piece of said two-piece structure of said resin casing so as to engage a engagement step portion of the engagement lever of the modular plug when the modular plug is disposed in a deepest pushed position within said jack body.

14. The modular jack according to claim 8, wherein said resin casing has engagement projections extending outwardly from said first and second side walls of said resin casing past said metal shell.

15. A modular jack adaptable to accommodate a modular plug therein, the modular plug including a plug body and an engagement lever, said modular jack comprising:

a resin casing being a one-piece integral structure having a first resin casing portion which includes a first side wall having an engagement portion adaptable to engage the engagement lever of the modular plug, and a second resin casing portion including a second side wall for holding at least one contact pin; and a metal shell being a hollow, approximately rectangular shape in cross-section so as to surround an outer periphery of said resin casing, said metal shell having short left and right side surface portions and long upper and lower surface portions, said metal shell being fixed to said resin casing, and said metal shell together with said resin casing defining an insertion concave portion in a jack body of said modular jack such that said first side wall of said first resin casing portion of said resin casing is located adjacent to and contacts an inner surface of said left side surface portion of said metal shell, said second side wall of said second resin casing portion of said resin casing is located adjacent to and contacts an inner surface of said right side surface portion of said metal shell, wherein said resin casing is side-less in a direction perpendicular to said first and second side walls so that there is no resin material of said resin casing adjacent to a major portion of inner surfaces of said upper and lower surface portions of said metal shell.

16. The modular jack according to claim 15, wherein an opening portion is defined by said resin casing and said metal shell, and said opening portion is located adjacent to a base end portion of the engagement lever of the modular plug when said insertion concave portion of said jack body houses the modular plug at a deepest pushed position of the modular plug.

17. The modular jack according to claim 15, wherein said at least one contact pin is first and second contact pins, and each of said first and second contact pins are connected to an L-shaped lead portion, said L-shaped lead portion extending outwardly from a right side surface portion of said metal shell.

18. The modular jack according to claim 15, wherein:

said first resin casing portion is fixed to said metal shell via first and second engagement pieces in said metal shell which mate with first and second engagement concave portions in said first resin casing portion; and said second resin casing portion is fixed to said metal shell via first and second fitting pieces in said metal shell which mate with first and second fitting grooves in said second resin casing portion.

19. The modular jack according to claim 15, wherein said engagement portion of said first resin casing portion extends into said insertion concave portion from said first side wall of said first resin casing portion so as to engage a engagement step portion of the engagement lever of the modular plug when the modular plug is disposed in a deepest pushed position within said jack body.

20. The modular jack according to claim 15, wherein said at least one contact pin has a bend portion at a first end thereof, said bend portion being located in a guide groove in said second resin casing portion and said bend portion being connected to an elastic contact portion of said at least one contact pin such that when the modular plug is moved into said insertion concave portion of said jack body, the plug body of the modular plug contacts said elastic contact portion of said at least one contact pin to deflect said elastic contact pin toward said second side wall of said second resin casing portion and to move said bend portion of said at least one contact pin in said guide groove towards said second side wall of said second resin casing portion.

21. The modular jack according to claim 15, wherein said resin casing has engagement projections extending outwardly from said first and second side walls of said resin casing past said metal shell.

* * * * *